US009469022B2

(12) United States Patent
Ishikawa

(10) Patent No.: US 9,469,022 B2
(45) Date of Patent: Oct. 18, 2016

(54) DRIVING TOOLS

(75) Inventor: Naoharu Ishikawa, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 1169 days.

(21) Appl. No.: 13/429,757

(22) Filed: Mar. 26, 2012

(65) Prior Publication Data

US 2012/0248168 A1 Oct. 4, 2012

(30) Foreign Application Priority Data

Mar. 31, 2011 (JP) ..... 2011-077863

(51) Int. Cl.
*B25C 1/00* (2006.01)

(52) U.S. Cl.
CPC ..... *B25C 1/005* (2013.01); *B25C 1/008* (2013.01)

(58) Field of Classification Search
CPC ..... B25C 1/005
USPC ..... 227/119, 110, 109, 107, 139, 120, 125, 227/126, 136
See application file for complete search history.

(56) References Cited

U.S. PATENT DOCUMENTS 5,803,338 A 9/1998 Singer et al.
6,267,284 B1 * 7/2001 Clark ..... B25C 1/184 227/119
6,279,808 B1 * 8/2001 Larsen ..... B25C 7/00 227/119
6,679,412 B1 * 1/2004 Thomas et al. ..... 227/119
6,892,922 B2 * 5/2005 Tucker et al. ..... 227/136
6,938,809 B1 9/2005 Schnell
7,028,875 B1 * 4/2006 Beville ..... B25C 5/1665 227/119
7,398,905 B2 * 7/2008 Chen ..... B25C 1/184 227/119
2004/0222266 A1 * 11/2004 Kakuda et al. ..... 227/8
2005/0001007 A1 1/2005 Butzen et al.
2006/0108389 A1 5/2006 Phillips
2007/0164075 A1 * 7/2007 Chen ..... B25C 1/184 227/119
2009/0057366 A1 * 3/2009 Braddock ..... B25C 1/005 227/120
2009/0200354 A1 8/2009 Arata et al.

FOREIGN PATENT DOCUMENTS

JP A-2000-15589 1/2000
JP A-2002-154069 5/2002
JP A-2006-26788 2/2006

OTHER PUBLICATIONS

Nov. 9, 2012 Extended European Search Report issued in Application No. EP12161765.8.
Aug. 26, 2014 Office Action issued in Japanese Application No. 2011-077863 (with translation).

* cited by examiner

*Primary Examiner* — Andrew M Tecco
*Assistant Examiner* — Chelsea Stinson
(74) *Attorney, Agent, or Firm* — Oliff PLC

(57) ABSTRACT

A driving tool may include a tool body, a magazine and a restricting member. The magazine may be coupled to the tool body and may be configured to store a fastener strip having fasteners connected in series with each other. The restricting member may be configured to permit the fastener strip to be inserted into the magazine to a predetermined position when the fastener strip is in a first orientation. The restricting member may prevent the fastener strip from being inserted into the magazine in the feeding direction to reach the predetermined position when the fastener strip is in a second orientation that is different from the first orientation.

12 Claims, 6 Drawing Sheets

DRIVING TOOLS

This application claims priority to Japanese patent application serial number 2011-077863, the contents of which are incorporated herein by reference.

BACKGROUND OF THE INVENTION

1. Field of the Invention

The present invention relates to driving tools for driving fasteners, such as nails.

2. Description of the Related Art

Known pneumatic nailers for driving nails have magazines for storing a plurality of nails. In general, nails stored in the magazine are fed one by one into a nail guide passage formed in a tool body. The nail guide passage is called a "driver guide." Some of known magazines are configured to store in a coiled state a series of wire-connected nails (known as a "collated nail"), in which nails are connected by wires at regular intervals. As disclosed in Japanese Laid-Open Patent Publication No. 2000-15589, some of other known magazines are configured to store a series of directly connected nails known as a "brad nail", in which nails are temporarily directly connected in parallel to each other in a form of a flat plate. In this specification, a serially connected nails including a collated nail and the brad nail will be hereinafter collectively referred to as a strip nail.

In the case of a magazine for storing a brad nail, the magazine is generally configured to extend between a driver guide of a tool body and an end portion of a handle in order to enable to store nails of the brad nail as many as possible and to provide a compact design. Therefore, as shown in FIG. 9, the magazine may be arranged such that the feeding direction (indicated by arrow S in FIG. 9) of the brad nail N is inclined relative to a direction perpendicular to the driving direction (indicated by arrow H in FIG. 9) of the nails.

Because the feeding direction S within the magazine is inclined relative to the direction perpendicular to the driving direction H, the brad nail N naturally has a configuration as shown in FIG. 9, in which nails n are temporarily directly connected to each other such that two adjacent nails n are displaced by a little distance from each other in the axial direction, so that the brad nail N has a configuration like a flat plate having a substantially lozenge shape.

In the case that a feeding direction of a brad nail from a magazine is perpendicular to a driving direction from a tool body, nails in the brad nail may not be necessary to be displaced from each other in their axial directions, and therefore, the heads of the nails may be aligned with each other.

However, as explained above with reference to FIG. 9, in the case that the feeding direction S of the brad nail N from the magazine is inclined relative to a direction perpendicular to the driving direction H from the tool body, two adjacent nails n are positioned so as to be displaced by a little distance relative to each other in their axial directions.

In the case of the brad nail N shown in FIG. 9, it may be possible that the brad nail N is loaded into the magazine in an improper orientation (back to front with respect to the feeding direction S) as shown in FIG. 10. If the brad nail N is loaded in the improper orientation, the nails n in the brad nail N are positioned such that their axial directions are do not parallel to the driving direction H of the tool body. Therefore, when the tool body is operated to drive the nails in this state, it may be possible that the frontmost nail n is clogged within the drive passage, resulting in an improper driving operation. For this reason, it is necessary for the operator to take care that the brad nail N is properly oriented when the brad nail N is loaded into the magazine.

Therefore, there has been a need in the art for a driving tool that can ensure that a fastener strip is loaded in a magazine in a proper orientation.

SUMMARY OF THE INVENTION

In one aspect according to the present teachings, a driving tool may include a tool body, a magazine and a restricting member. The magazine may be coupled to the tool body and may be configured to store a fastener strip having fasteners connected in series with each other. The restricting member may be configured to permit the fastener strip to be inserted into the magazine to a predetermined position when the fastener strip is in a first orientation. The restricting member may prevent the fastener strip from being inserted into the magazine in the feeding direction to reach the predetermined position when the fastener strip is in a second orientation that is different from the first orientation.

DETAILED DESCRIPTION OF THE INVENTION

Figure 1:
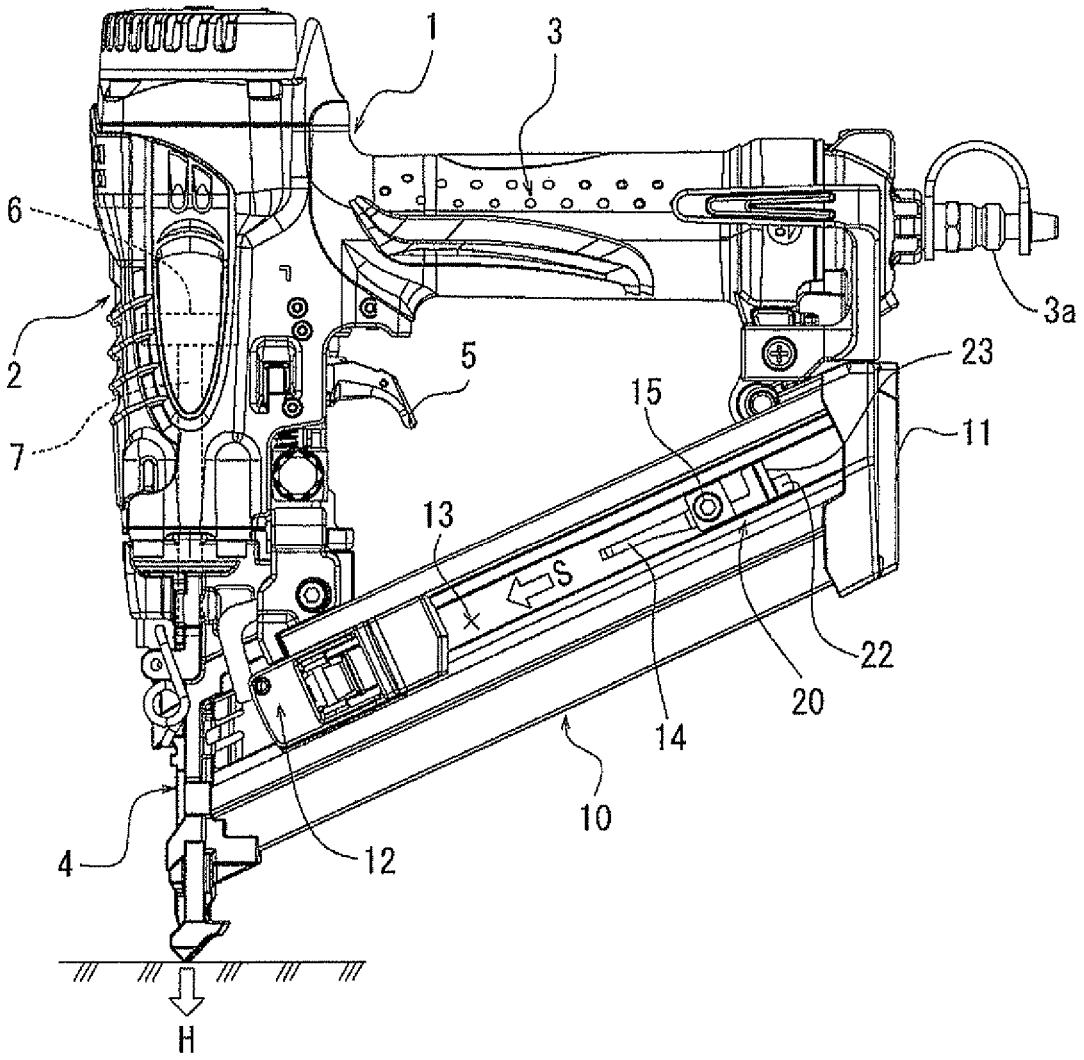
FIG. 1 is a side view of a driving tool.

Each of the additional features and teachings disclosed above and below may be utilized separately or in conjunction with other features and teachings to provide improved fastener driving tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a driving tool may include a tool body, a magazine and a restricting member. The magazine may be coupled to the tool body and may be configured to receive a fastener strip in a feeding direction. The fastener strip may have fasteners connected in the series with each other. The fasteners are arranged in parallel to each other and are displaced from each other in axial directions of the fasteners. The restricting member may permit the fastener strip to be inserted into the magazine in a feeding direction to reach a predetermined position for a driving operation by the tool body when the fastener strip is properly oriented. The restricting member may prevent the fastener strip from being inserted into the magazine in the feeding direction to reach the predetermined position when the fastener strip is improperly oriented. The axial directions of the fasteners may be substantially parallel to a driving direction of the nails when the fastener strip is properly oriented. The axial directions of the nails may not be parallel to the driving direction of the fasteners when the fastener strip is improperly oriented.

With this arrangement, the restricting member may prevent the fastener strip from being loaded into the magazine in the improper orientation. Therefore, it is possible to ensure that that fastener strip is loaded in the proper orientation. Hence, it is possible to prevent failure in the driving operation of the nails due to clogging of nails.

The restricting member may be mounted within the magazine and may include a guide portion and a restricting portion. As the properly oriented fastener strip is inserted into the magazine in the feeding direction, the fastener strip may interact with the guide portion to cause movement of the restricting portion from a restricting position to a rest position, so that the fastener strip is permitted to reach the predetermined position. As the improperly oriented fastener strip is inserted into the magazine in the feeding direction, the fastener strip may interact with the restricting portion, so that the fastener strip is prevented from reaching to the predetermined position.

In one example, as the properly oriented fastener strip is inserted into the magazine in the feeding direction, the fastener strip may first interact with the guide portion. On the other hand, as the improperly oriented fastener strip is inserted into the magazine in the feeding direction, the fastener strip may first interact with the restricting portion. Thus, the restriction member may be configured in light of change of inclination angle of the front end of the fastener strip between the proper orientation and the improper orientation.

The guide portion and the restricting portion of the restricting member may be formed integrally with each other. With this arrangement, the construction of the restricting member may be simplified.

The driving tool may further include a stopper member configured to prevent the fastener strip from moving in a direction opposite to the feeding direction after the fastener strip has reached to the predetermined position. The stopper member may be formed integrally with the restricting member. With this arrangement, the number of parts of the driving tool can be minimized and the assembling operation of the driving tool can be facilitated.

A representative example will now be described with reference to the drawings. Referring to FIG. 1, a driving tool 1 is configured as a pneumatic nailer. The driving tool 1 generally includes a tool body 2, a handle 3, a nose 4 and a magazine 10. A piston 6 is disposed within the tool body 2 and may be reciprocally driven by a compressed air serving as a drive source. A driver 7 is connected to the piston 6. A handle 3 extends laterally from the tool body 2. A plug 3*a* is provided at the rear end of the handle 3 for connection with an air hose (not shown) through which a compressed air is supplied. A trigger-type switch lever 5 is mounted to the lateral side of the tool body 2 at a position proximal to the front end of the handle 3. The operator can grasp the handle 3 and can push the switch lever 5 with his or her finger(s), so that the compressed air is supplied to an upper chamber of a cylinder (not shown), within which the piston 6 is received. Then, the piston 6 moves downward within the cylinder, so that the driver 7 connected to the piston 6 moves downward to drive one of fasteners supplied in to the nose 4, so that the driven fastener goes out from the lower end of the nose 4. In this example, the fasteners are nails and are loaded into the magazine 10 in a form of a strip nail, more specifically, in a form of a brad nail N as previously described with reference to FIG. 9.

The nose 4 is mounted to the tool body 2 such that it extends downward (in the driving direction) from the lower end of the tool body 2. The driver 7 is reciprocally movably received within the nose 4. The nails n in the brad nail N are supplied one by one from the magazine 10 into the nose 4.

Figure 8:
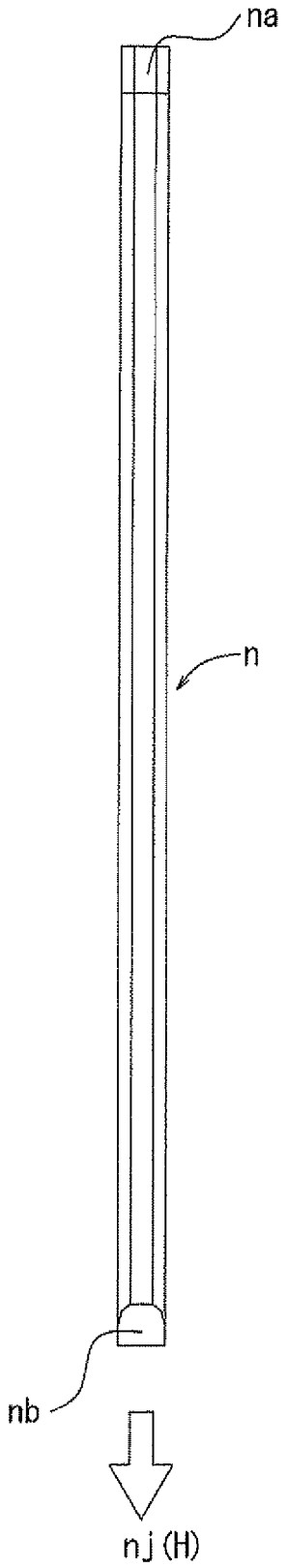
FIG. 8 is a side view of one of nails.

The magazine 10 is mounted to extend between the lower end of the nose 4 and the rear end of the handle 3. The magazine 10 is inclined relative to a driving direction (indicated by outline arrow H in FIG. 1) for driving nails n such that a loading portion 11 at the rear end (right end as viewed in FIG. 1) of the magazine 10 is positioned on the upper side relative to the front end of the magazine 10. As shown in FIG. 8, each of the nails n has a head na and a leading end nb on opposite sides in the longitudinal direction. As described previously, for the magazine 10 of this example, the brad nail N having a series of nails n temporally directly connected to each other as described with reference to FIG. 9 may be used. More specifically, two adjacent nails n of the brad nail N are displaced by a little distance from each other in their axial directions nj such that the head na of one of the two adjacent nails n positioned on the rear side with respect to the feeding direction S is at a higher level than the head na of the other of the two adjacent nails n positioned on the front side. Therefore, the feeding direction S of the brad nail N within the magazine 10 is inclined relative to a direction perpendicular to the driving direction H such that the feeding direction S inclined downwardly toward the front side. In addition, in this example, the direction of loading the brad nail N into the loading portion 11 is set to be the same as the feeding direction S.

Figure 4:
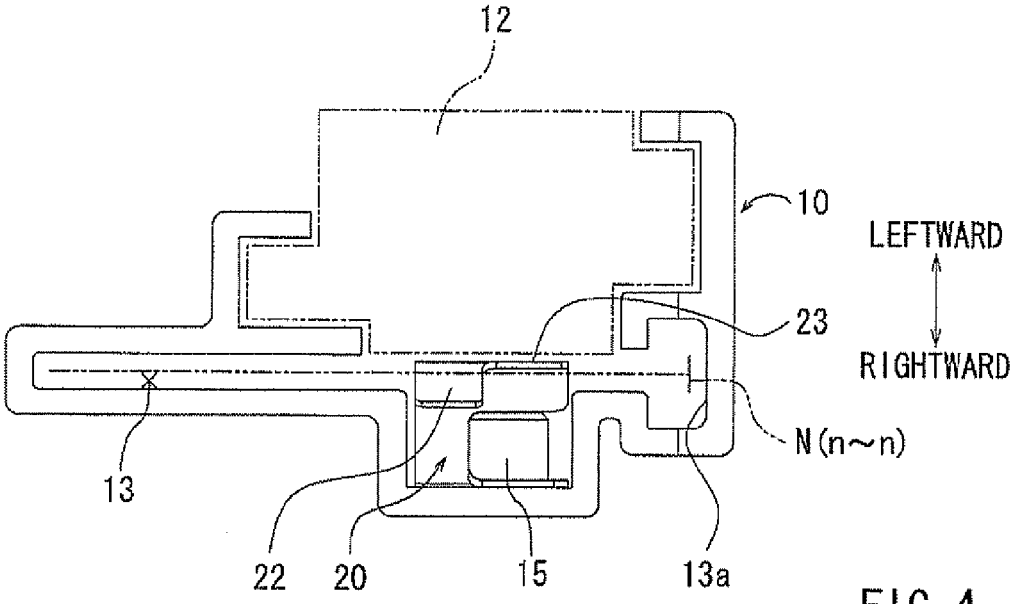
FIG. 4 is a view as viewed in a direction indicated by arrow (IV)-(IV) in FIG. 2.

As shown in FIG. 4, a nail storage space 13 is defined in the magazine 10 for storing the brad nail N that has a thin plate-like shape. The nail storage space 13 includes a head storage space 13*a* at its upper end for receiving the heads na of the nails n. Because the width of the head storage space 13*a* is broader than the remaining portion of the nail storage space 13, the brad nail N cannot be inserted into the nail storage space 13 if the brad nail N is inversely oriented in the vertical direction such that the heads na are positioned on the lower sides of the leading ends nb.

A pusher 12 may be provided for pushing the brad nail N in the driving direction S. The pusher 12 may be mounted within the nail storage space 13 such that it can slide in the feeding direction S. The pusher 12 may be biased by a leaf spring (not shown) in the feeding direction S. The pusher 12 may have a feed claw (not shown) that can engage the rear end of the brad nail N, so that the brad nail N can be pushed by the pusher 12 in the feeding direction S. Therefore, as the nails n of the brad nail N are driven one by one, the brad nail N is intermittently fed into the nose 4 by a distance corresponding to the thickness of the nail n by the pusher 12.

Figure 2:
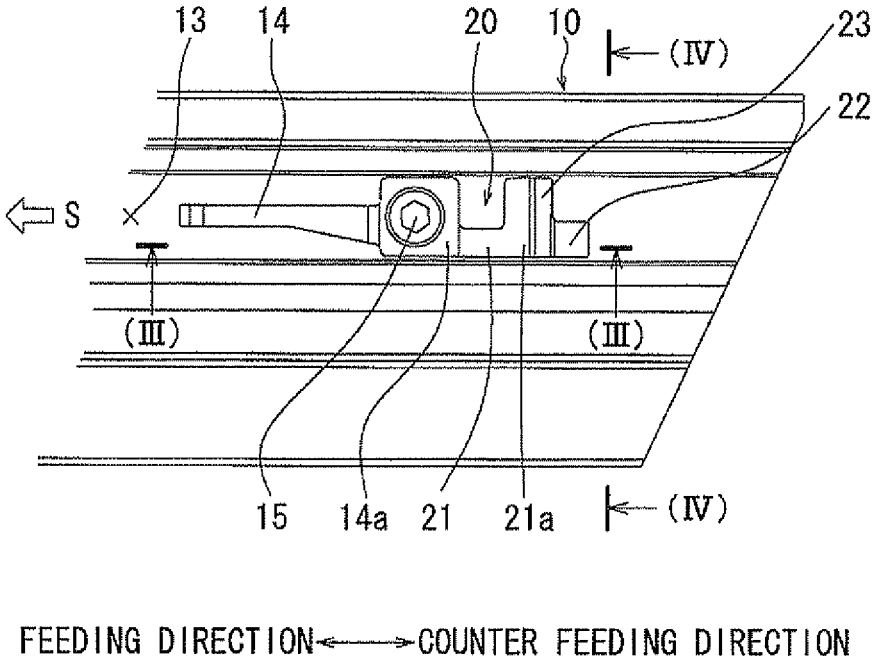
FIG. 2 is an enlarged sided view of a part of a magazine of the driving tool and showing a restricting member.
Figure 3:
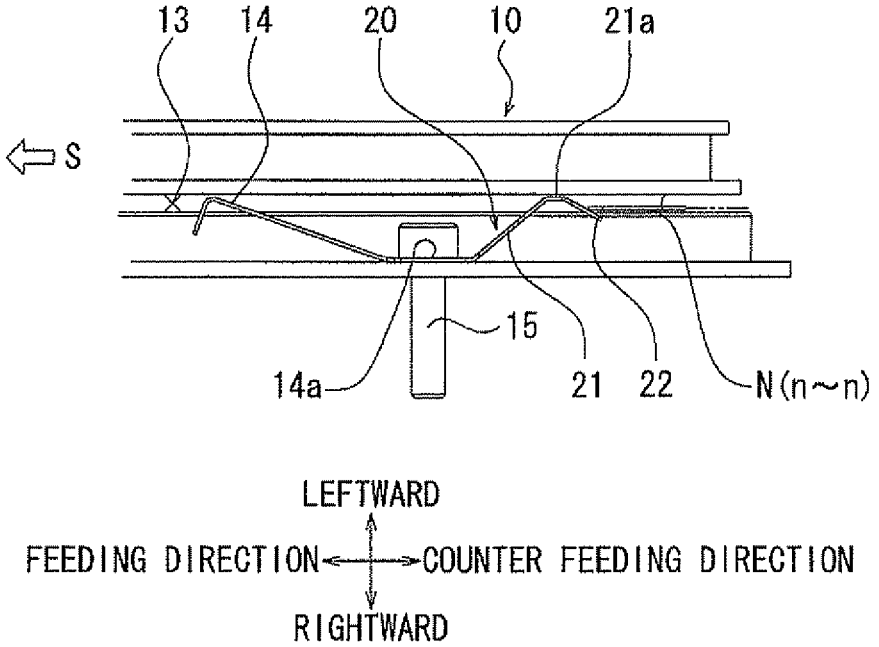
FIG. 3 is a view as viewed in a direction indicated by arrow (III)-(III) in FIG. 2.

A stopper 14 is mounted within the rear portion of the nail storage space 13 at a position adjacent to the loading portion 11. The stopper 14 serves to prevent the brad nail N from moving rearwardly opposite to the feeding direction S. As shown in FIGS. 2 and 3, the stopper member 14 has a base portion 14*a* that is fixedly attached to the right side wall of the nail storage space 13 by a fixing screw 15. The stopper member 14 extends forwardly in the feeding direction and diagonally leftward from the base portion 14*a* across a nail plane, along which the brad nail N moves in the feeding direction S within the nail storage space 13.

As the brad nail N is loaded into the nail storage space 13 via the loading portion 11, the brad nail N contacts the stopper member 14 to force the stopper member 14 to be resiliently deformed toward the right side wall of the nail storage space 13 away from the nail plane, so that the brad nail N can move further in the feeding direction S. After the brad nail N has been moved in the feeding direction S forwardly beyond the stopper member 14, the operator may move the pusher 12 rearwardly against the biasing force of the leaf spring to a position on the rear side of the brad nail N. During the rearward movement of the pusher 12, the stopper member 14 may prevent the brad nail N from moving rearwardly. Therefore, the operation for loading the brad nail N into the nail storage space 13 can be easily performed without need of holding the brad nail N in position by a hand of the operator during the movement of the pusher 12 to a position on the rear side of the loaded brad nail N.

The brad nail N usable in this example has a configuration like a flat plate having a lozenge shape (see FIG. 9) and the axial direction nj of each of the nails n is parallel to the driving direction H. As described in connection with the related art, if the brad nail N is loaded into the magazine 10 in an improper orientation (back-to-front orientation) as shown in FIG. 10, the axial directions nj of the nails n may not be parallel to the driving direction H. Therefore, when the driver 7 moves downward to apply a driving force to the head na of the nail at the frontmost of the brad nail N, it may be possible that the head na may be deformed. The deformation of the head na of the nail n may cause the nail n to be clogged within the drive passage of the nose 4.

Figure 5:
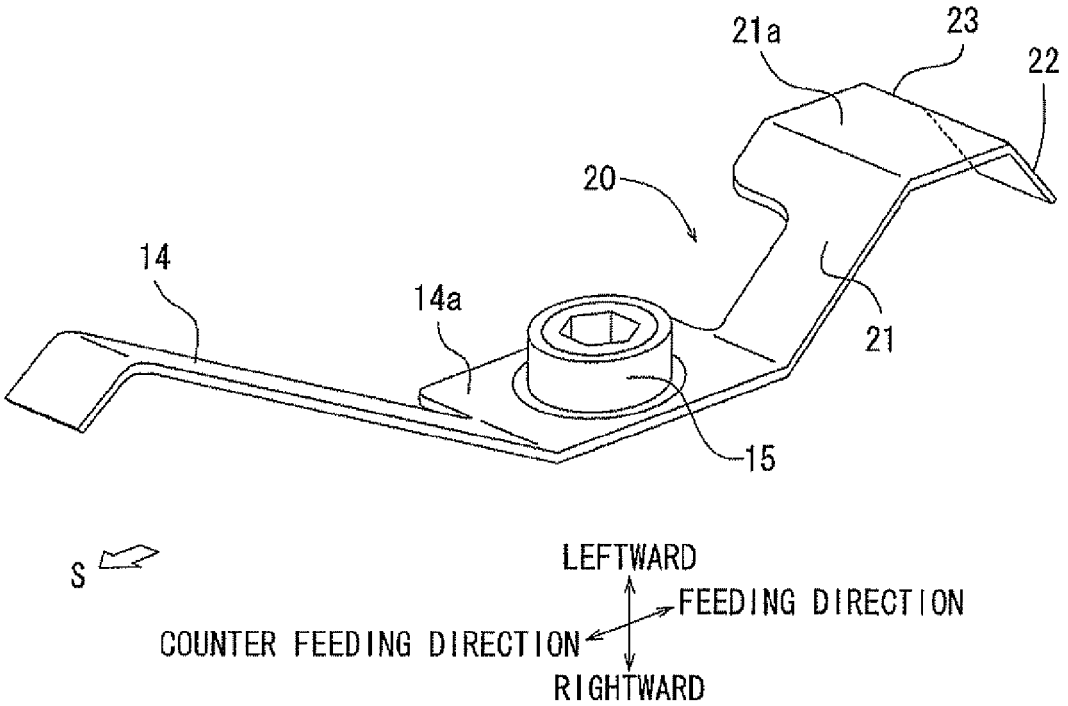
FIG. 5 is a perspective view of the restricting member integrated with a stopper member.

In order to prevent potential deformation of the head na of the nail n that is driven or to prevent potential clogging of the deformed nail n, a restricting member 20 is provided in this example. As shown in FIG. 1, the restricting member 20 is positioned adjacent to the loading portion 11 of the magazine 10. The restricting member 20 may be formed integrally with the base portion 14*a* of the stopper 14 as shown in FIG. 5. More specifically, the stopper member 14 and the restricting member 20 may be made of a thin steel plate that can be resiliently deformed.

The restricting member 20 extends rearwardly from the base portion 14*a* in a direction opposite to the feeding direction S. The restricting member 20 includes an arm portion 21 extending diagonally leftward in the direction opposite to the feeding direction across the nail plane within the nail storage space 13. A broad width portion 21*a* having a width (in a vertical direction perpendicular to the feeding direction S) larger than that of the arm portion 21 is formed at the rear end of the arm portion 21. A guide portion 22 is formed at the rear end of the broad width portion 21*a*. The guide portion 22 extends in the direction opposite to the feeding direction S and is bent diagonally rightward across the nail plane. A substantially half the region of the broad width portion 21*a* positioned on the upper side as viewed in FIG. 2 is configured as a restricting portion 23.

As shown in FIGS. 3 and 4, when no load is applied, the broad width portion 21*a* is positioned on the left side of the nail plane. Therefore, the guide portion 22 extends across the nail plane from the left side to the right side. On the other hand, the restricting portion 23 is positioned on the left side of the nail plane.

Figure 9:
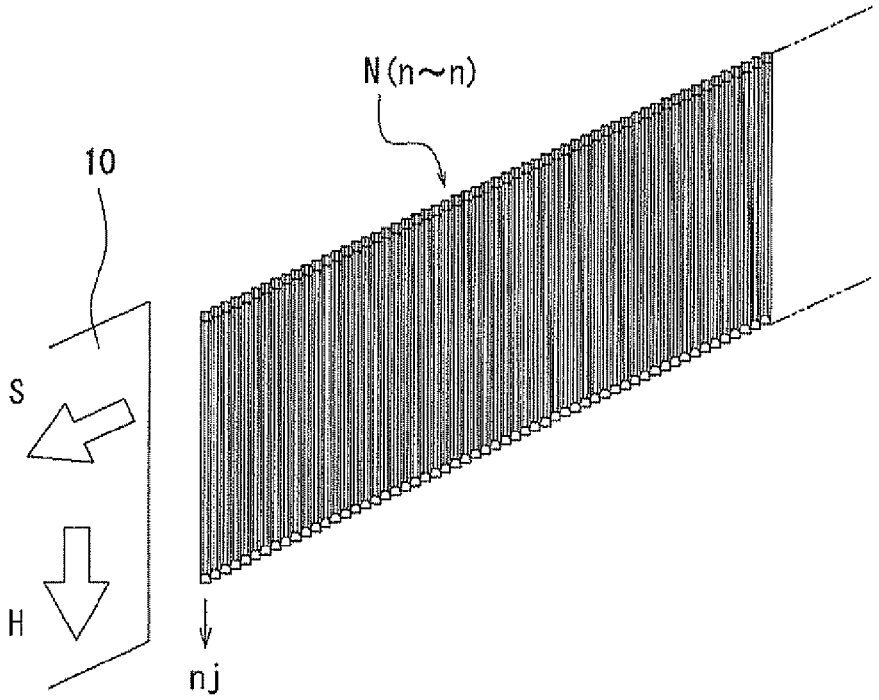
FIG. 9 is an explanatory view showing the relationship between the properly oriented nail strip, a feeding direction of the nail strip and a driving direction of nails.
Figure 10:
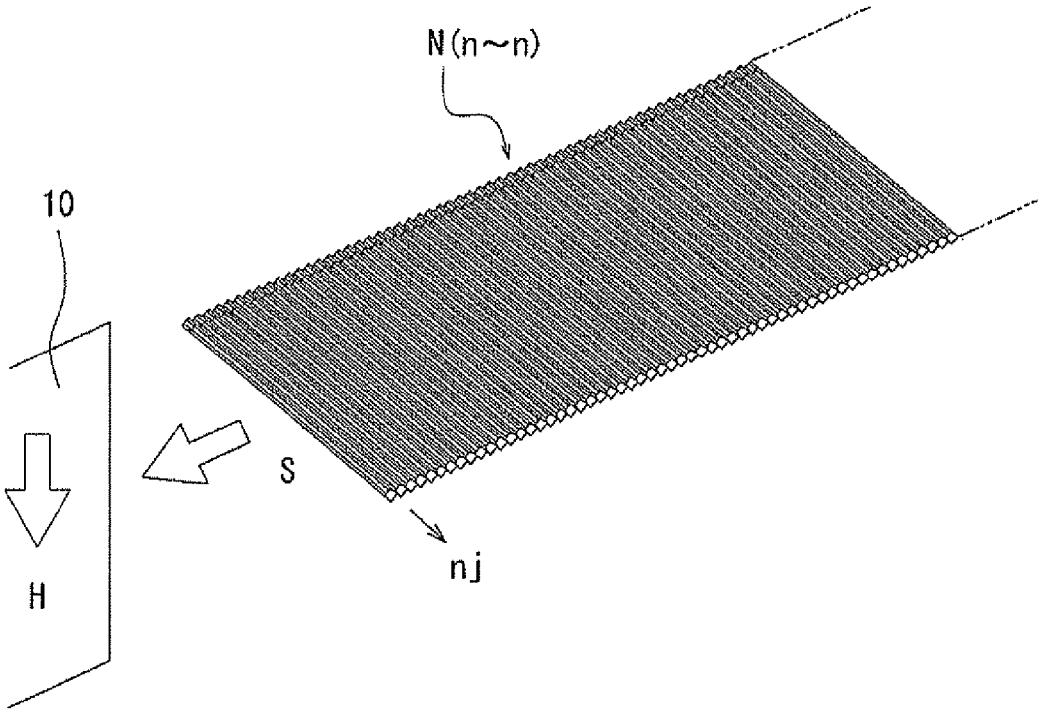
FIG. 10 is an explanatory view showing the relationship between the improperly oriented nail strip, the feeding direction of the nail strip and the driving direction of nails.

When the brad nail N is loaded into the magazine 10 in the proper orientation shown in FIG. 9, the head na of each nail n (see FIG. 8) is positioned rearwardly of the leading end nb with respect to the feeding direction S. Therefore, as the brad nail N is loaded into the magazine 10 in the proper orientation from the loading portion 11, the leading end nb of each nail n moves in the feeding direction S within the nail storage space 13 in advance of the movement of the head na. For this reason, the front end of the brad nail N first contacts the surface of the guide portion 22 that is positioned rearwardly downwardly of the restricting portion 23. Then, the front end of the brad nail N forces the guide portion 22 to move rightward due to the resilient deformation of the restricting member 20 primarily at the arm portion 21. Therefore, the restricting member 20 moves laterally (rightwardly in FIG. 3) away from the nail plane. As a result, the brad nail N can move further forwardly beyond the restricting member 20. After the brad nail N has moved to a position forwardly of the stopper member 14, the operator may move the pusher 12 to a position rearwardly of the brad nail N, so that the pusher 12 can push the brad nail N forwardly.

Figure 6:
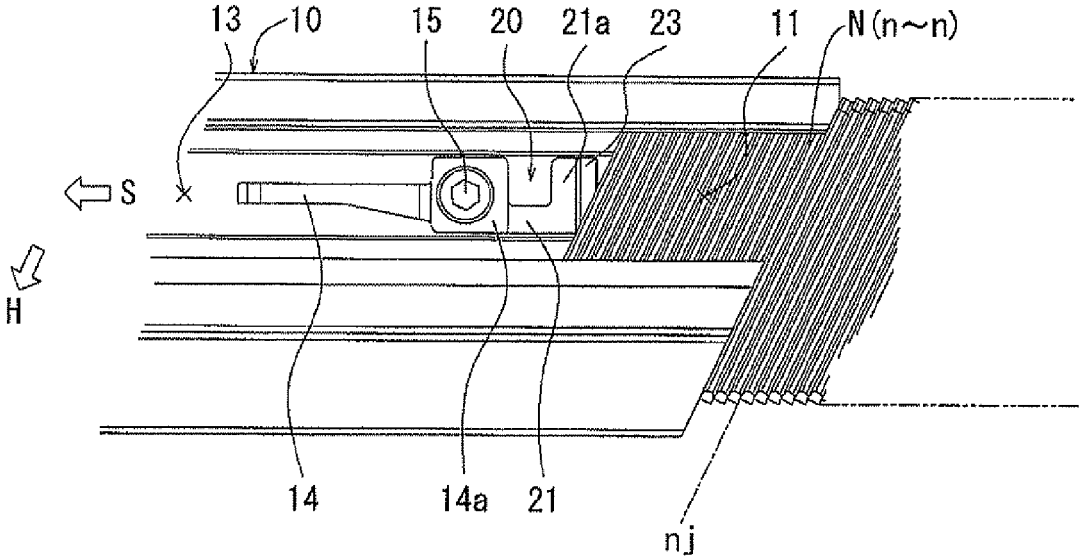
FIG. 6 is a side view of a part of the magazine showing the relationship between the restricting member and a nail strip when the nail strip is loaded in a proper orientation.
Figure 7:
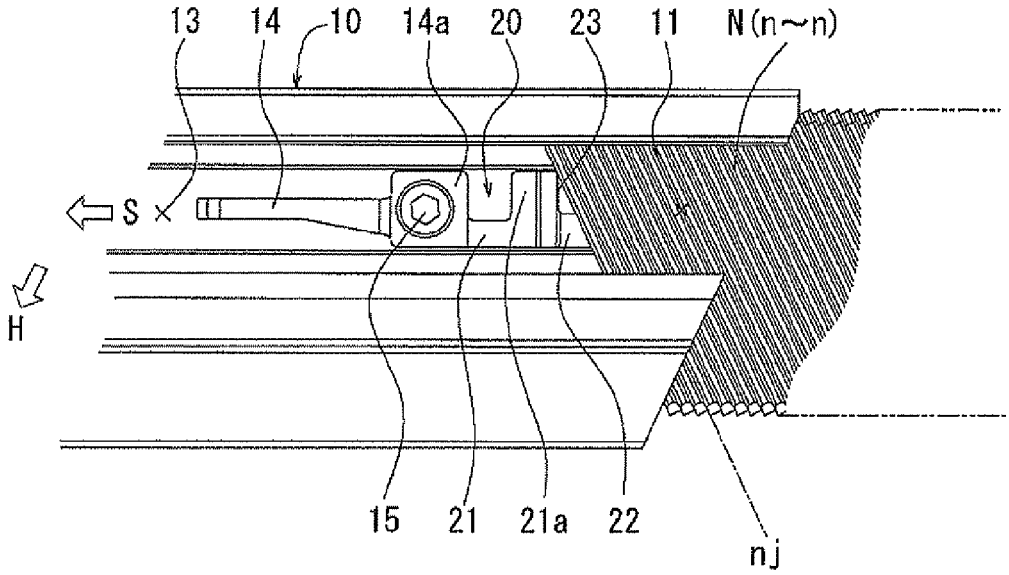
FIG. 7 is a side view similar to FIG. 6 but showing the relationship between the restricting member and the nail strip when the nail strip is loaded in an improper orientation.

On the other hand, when the brad nail N is loaded into the magazine 10 in the improper orientation shown in FIG. 10, the head na of each nail n may be positioned forwardly of the leading end nb with respect to the feeding direction S. Therefore, as the brad nail N is loaded into the magazine 10 from the loading portion 11 as shown in FIG. 7, the head na of each nail n moves in the feeding direction S within the nail storage space 13 in advance of the movement of the leading end nb. Then, the front end of the brad nail N first moves to a position laterally behind the restricting portion 23 (i.e., on the right side of the restricting member 23). As the brad nail N moves further in the feeding direction S, the front end of the brad nail N may be caught between the right side surface of the restricting portion 23 and the left side surface of the guide portion 22. Therefore, the restricting member 20 may not be moved laterally away from the nail plane. As a result, the brad nail N may be prevented from moving further into the nail storage space 13 in the feeding direction S. When this occurs, the operator may remove the brad nail N from the nail storage space 13 in order to change the orientation of the brad nail N to the proper orientation. The brad nail N that was properly oriented can then be loaded into the nail storage space 13 as described previously with reference to FIG. 6 without interruption by the restricting member 20.

As described above, according to this example, when the brad nail N is loaded into the magazine 10 in the proper orientation in which the axial direction nj of each nail n is parallel to the driving direction H, the front end of the brad nail N first contacts the guide portion 22 of the restricting member 20 before the front end reaches to a position of the restricting portion 23. Therefore, the restricting member 20 can move to a position away from the nail plane through interaction between the front end of the brad nail N and the guide portion 22. As a result, the brad nail N can be moved further to a position for driving the nails n by the driver 7.

On the other hand, if the brad nail N is loaded into the magazine 10 in the improper orientation in which the axial direction nj of each nail n is not parallel to the driving direction H, the front end of the brad nail N first moves to a position laterally behind the restricting portion 23. Therefore the brad nail N may be caught between the restring portion 23 and the guide portion 22. Hence, the restricting member 20 can prevent the brad nail N from being loaded in the improper orientation.

As described above, if the brad nail N is turned back to front or is reversed from the proper orientation to the improper orientation, the axial direction nj of each nail n may be changed not to be parallel to the driving direction H. Because the front edge of the brad nail N is defined by the frontmost nail n, the front edge extends in parallel to the axial direction nj. For this reason, the inclination angle of the front edge of the brad nail N relative to the feeding direction S may be different between the properly oriented state and the improperly oriented state of the brad nail N. In the above example, this difference in the inclination angle of the front edge of the brad nail N is used for enabling the restricting member 20 to prevent the brad nail N from moving further if the brad nail N is loaded in the improper orientation.

Because the brad nail N may not be loaded into the magazine 10 to a position for driving by the driver 7 unless it is properly oriented, it is possible to ensure that the brad nail N is loaded into the magazine 10 in the proper orientation. Therefore, it is possible to prevent the nail(s) n from being clogged within the driver passage of the nose 4. As a result, it is possible to prevent failure in operation of the driving tool 1.

In addition, in the above example, the restricting member 20 has the guide portion 22 and the restricting portion 23 that are formed integrally with each other. Further, the restricting member 20 is formed integrally with the stopper member 14 that can prevent the brad nail N from moving in the direction opposite to the feeding direction S after the brad nail N has been loaded. Therefore, the number of parts can be minimized and the assembling operation of the restricting member 20 with the guide portion 22 and the restricting portion 23 and with the stopper member 14 may not be necessary.

The above example may be modified in various ways. For example, although the stopper member 14 is formed integrally with the restricting member 20, the stopper member 14 and the restricting member 20 may be formed separately from each other. In such a case, the restricting member 20 may be mounted within the nail storage space 13 at a position rearwardly of the stopper member 14.

Further, although the broad width portion 21*a* is formed on the rear side of the arm portion 21 that is narrower in width than the broad width portion 21*a*, it may be possible that the arm portion 21 has the same width as the broad width portion 21*a*.

Furthermore, although the brad nail N has been exemplified for use with the driving tool 1, the above teachings can be also applied to the other type of strip nail, such as nails serially connected by a resin sheet, a paper sheet or wires (collated nail), as long as the nails are positioned at regular intervals in the feeding direction and are displaced from each other in directions parallel to the axial directions of the nails.

Further, although the above example has been described in connection with the driving tool 1 used for driving nails, the above teachings can be also applied to driving tools for driving the other types of fasteners, such as staples and rivets, as long as the fasteners are serially connected to each other to form a fastener strip, in which the fasteners are positioned at regular intervals in the feeding direction and are displaced from each other in directions parallel to the axial directions of the fasteners.

What is claimed is:

1. A driving tool comprising:

a tool body;

a magazine coupled to the tool body and configured to receive a fastener strip, the fastener strip being inserted into the magazine by moving in a feeding direction, the fastener strip having fasteners connected in the series with each other, the fasteners being arranged in parallel to each other and displaced from each other in axial directions of the fasteners; and a restricting member permitting the fastener strip to be inserted into the magazine in the feeding direction to reach a predetermined position for a driving operation by the tool body when the fastener strip is properly oriented, the restricting member preventing the fastener strip from being inserted into the magazine in the feeding direction to reach the predetermined position when the fastener strip is improperly oriented, wherein the axial directions of the fasteners are substantially parallel to a driving direction of the fasteners when the fastener strip is properly oriented;

the axial directions of the fasteners are not parallel to the driving direction of the fasteners when the fastener strip is improperly oriented, the restricting member is mounted within the magazine and includes a guide portion and a restricting portion;

as the properly oriented fastener strip is inserted into the magazine in the feeding direction, the fastener strip interacts with the guide portion to cause movement of the restricting portion from a restricting position to a rest position, so that the fastener strip is permitted to reach the predetermined position;

as the improperly oriented fastener strip is inserted into the magazine in the feeding direction, the fastener strip interacts with the restricting portion, so that the fastener strip is prevented from reaching to the predetermined position;

the guide portion and the restricting portion of the restricting member are formed integrally with each other as a single-piece member;

the restricting member further includes a base portion, the base portion being fixedly attached to a wall of a nail storage space of the magazine;

the restricting portion extends rearwardly from the base portion in a direction opposite to the feeding direction: and the guide portion, the restricting portion and the base portion of the restricting member are formed integrally with each other as the single-piece member.

2. The driving tool as in claim 1, wherein as the properly oriented fastener strip is inserted into the magazine in the feeding direction, the fastener strip first interacts with the guide portion; and as the improperly oriented fastener strip is inserted into the magazine in the feeding direction, the fastener strip first interacts with the restricting portion.

3. The driving tool as in claim 1, further comprising a stopper member configured to prevent movement of the fastener strip from moving in a direction opposite to the feeding direction after the fastener strip has reached to the predetermined position.

4. The driving tool as in claim 3, wherein the stopper member is formed integrally with the restricting member as the single-piece member.

5. The driving tool as in claim 1, wherein the fastener strip has a substantially lozenge shape and has a front end in the feeding direction, the front end is inclined in a first direction relative to a direction perpendicular to the feeding direction when the properly oriented fastener strip is inserted into the magazine, and the front end is inclined in a second direction relative to the direction perpendicular to the feeding direction when the improperly oriented fastener strip is inserted into the magazine, and the first direction and the second direction are opposite to each other.

6. The driving tool as in claim 1, wherein the fasteners are nails.

7. A driving tool comprising:

a tool body;

a magazine coupled to the tool body and configured to store a fastener strip having fasteners connected in series with each other, the fastener strip being inserted into the magazine by moving in a feeding direction; and a restricting member configured to permit the fastener strip to be inserted into the magazine to a predetermined position when the fastener strip is in a first orientation, the restricting member preventing the fastener strip from being inserted into the magazine in the feeding direction to reach the predetermined position when the fastener strip is in a second orientation that is different from the first orientation;

wherein the restricting member is mounted within the magazine and includes a guide portion and a restricting portion;

as the fastener strip in the first orientation is inserted into the magazine in the feeding direction, the fastener strip interacts with the guide portion to cause movement of the restricting portion from a restricting position to a rest position, so that the faster strip is permitted to reach the predetermined position;

as the fastener strip in the second orientation is inserted in to the magazine in the feeding direction, the fastener strip interacts with the restricting portion, so that the fastener strip is prevented from reaching to the predetermined position;

the guide portion and the restricting portion of the restricting member are formed integrally with each other as a single-piece member;

the restricting member further includes a base portion, the base portion being fixedly attached to a wall of a nail storage space of the magazine;

the restricting portion extends rearwardly from the base portion in a direction opposite to the feeding direction; and the guide portion, the restricting portion and the base portion of the restricting member are formed integrally with each other as the single-piece member.

8. The driving tool as in claim 7, wherein the first orientation and the second orientation are opposite to each other.

9. The driving tool as in claim 1, wherein the feeding direction is inclined relative to a direction perpendicular to the driving direction of the fasteners.

10. The driving tool as in claim 1, wherein:

the restricting portion is positioned on the side of a loading portion of the magazine with respect to the base portion, and the guide portion is positioned on the side of the loading portion of the magazine with respect to the restricting portion.

11. The driving tool as in claim 7, wherein:

the restricting portion is positioned on the side of a loading portion of the magazine with respect to the base portion, and the guide portion is positioned on the side of the loading portion of the magazine with respect to the restricting portion.

12. The driving tool as in claim 7, wherein the feeding direction is inclined relative to a direction perpendicular to a driving direction of the fasteners.

* * * * *